United States Patent [19]

Asakura et al.

[11] Patent Number: 5,058,560

[45] Date of Patent: Oct. 22, 1991

[54] CONTACTLESS IGNITION APPARATUS FOR INTERNAL COMBUSTION ENGINE

[75] Inventors: Hideo Asakura, Toyohashi; Motokazu Momiyama, Okazaki, both of Japan

[73] Assignee: Nippondenso Co., Ltd., Kariya, Japan

[21] Appl. No.: 583,699

[22] Filed: Sep. 17, 1990

[30] Foreign Application Priority Data

Sep. 19, 1989 [JP] Japan ..... 1-243098
Jul. 3, 1990 [JP] Japan ..... 2-177142

[51] Int. Cl.[5] ..... F02P 3/04

[52] U.S. Cl. ..... 123/633; 123/644; 123/652

[58] Field of Search ..... 123/609, 633, 644, 651, 123/652

[56] References Cited

U.S. PATENT DOCUMENTS

| | | | |
|---|---|---|---|
| 2,966,615 | 12/1960 | Meyer et al. | 123/652 |
| 4,044,733 | 8/1977 | Suda | 123/610 |
| 4,112,903 | 9/1978 | Sugiura et al. | 123/651 |
| 4,128,091 | 12/1978 | Balan et al. | 123/611 |
| 4,185,603 | 1/1980 | Sohner et al. | 123/609 |
| 4,290,406 | 9/1981 | Iyoda et al. | 123/645 |
| 4,368,717 | 1/1983 | Roberts et al. | 123/644 X |
| 4,653,460 | 3/1987 | Ooyabu et al. | 123/645 |

FOREIGN PATENT DOCUMENTS 6464 2/1988 Japan .

*Primary Examiner*—Tony M. Argenbright
*Attorney, Agent, or Firm*—Cushman, Darby & Cushman

[57] ABSTRACT

A contactless ignition apparatus for an internal combustion engine comprises a resin-molded closed magnetic circuit type ignition coil including an iron core constituting a closed magnetic circuit, a primary winding and a secondary winding wound around the iron core, respectively, and mold resin for insulating the primary and secondary winding, a semiconductor switching circuit for interrupting a current flowing to the primary winding, and an ignition plug to which a high voltage generated in the secondary winding upon interruption of the primary current flow to the primary winding by the semiconductor switch circuit. The falling rate dI/dt of the primary current upon interruption thereof by the semiconductor switching circuit is set at a value in a range of 0.2 to 0.4 A/μs. Noise radiation from the ignition coil can be reduced significantly.

4 Claims, 10 Drawing Sheets

CONTACTLESS IGNITION APPARATUS FOR INTERNAL COMBUSTION ENGINE

BACKGROUND OF THE INVENTION

The present invention generally relates to a contactless ignition apparatus for an internal combustion engine in which an ignition coil of resin molded closed magnetic circuit type ignition coil is employed. More particularly, the present invention is concerned with a structure for supressing or reducing noise generated by the ignition apparatus.

In the closed magnetic circuit (path) type ignition coil which is employed in the contactless ignition apparatus for the internal combustion engine, the magnetic circuit is implemented as the closed path by combining appropriately E- or L-shaped laminated cores each formed of a lamination of silicon steel plates or sheets. By virtue of this structure, the closed magnetic circuit type ignition coil and hence the contactless ignition apparatus can enjoy profitable features such as high efficiency, capability of miniaturizing the size of the ignition coil, improved insulation property and high vibration withstanding capability owing to the use of thermosetting resin such an epoxy resin or the like as the insulating material, and so forth. For this reason, the closed magnetic circuit type ignition coil is widely used in place of the oil-filled open magnetic circuit type ignition coil.

However, the contactless ignition apparatus in which the closed magnetic circuit type ignition coil is used has encountered a problem that upon supplying high energy to an ignition plug connected to a secondary winding of the ignition coil by interrupting a current flowing through a primary winding, noise is generated by the ignition coil itself.

The noise of concern is observed mainly in a low frequency band of several hundred kilohertzs or less, i.e. in the AM band of radio broadcasting and can not be suppressed sufficiently by the noise reducing measures adopted heretofore such as connection of a capacitor to the primary circuit of the ignition coil (as is disclosed, for example, in Japanese Utility Model Publication No. 6464/1988). As a result, reception of radio broadcast programs in the areas where the electric field is enfeebled or the reception in the unfavorable conditions such as experienced within a motor vehicle equipped with a receiving antenna incorporated integrally in a window glass undergoes disturbance more or less.

As the result of noise measurements performed by the inventor of the present application on a variety of ignition apparatuses in a frequency band of several hundred kilohertzs or less, it has been found that (1) noise of significant magnitude is observed even in the case of distributorless ignition apparatuses which are generally known as the low-noise device, and (2) in the case of the contactless ignition apparatuses, (a) some of the oil-filled iron-case type ignition coils are relatively less liable to noise generation, while (b) some of epoxy resin filled or mold type ignition coils generate remarkable noise while the others are less prone to generate noise.

FIGS. 1 and 2 of the accompanying drawings show schematically arrangements of testers employed in the measurements mentioned above. In the figures, a reference numeral 1 denotes a closed magnetic path type ignition coil having a primary winding 10 and a secondary winding 11. A numeral 2 denotes an ignition plug connected to the secondary winding 11. A numeral 3 denotes an igniter which performs ON/OFF or interruption control of an electric current flowing to the primary winding 10 for thereby generating sparks at a predetermined ignition timing. Further, reference numeral 4 denotes a battery, 5 denotes a current probe for detecting the current flowing to the primary winding 10, numeral 6 denotes an oscilloscope used for allowing the current detected by current probe to be visually observed or recorded. A numeral 22 denotes an electric field probe disposed at a position distanced from the ignition coil 1 by 10 cm for detecting the field strength (intensity) of noise emitted by the ignition coil 1. A numeral 20 denotes a current probe for detecting a high-frequency current flowing through a power supply line for the ignition coil 1. Finally, a reference numeral 21 denotes a field strength indicator to serve for indicating the strength of the electric field detected by the electric field probe 22 and the high-frequency current detected by the current probe 20.

A variety of ignition coils including the molded coils and the cased coils were tested as samples or specimens by measuring noise radiation and noise current (or current noise) emitted from the ignition coils through the method illustrated in FIG. 1, the results of which are summarized in the following table 1.

TABLE 1

| | | | Measuring Frequency 300 kHz | | | | |
|---|---|---|---|---|---|---|---|
| Specimen No. | Type | Filler Material | Core Structure | Specification of Winding | Field Strength (Radiation Noise) | Noise Current | dI/dT |
| 1 | Molded Coil | Epoxy Resin | Closed Magnetic Path | Specification Ⓐ | 100 | 54 | 0.86 |
| 2 | \| | \| | \| | Specification Ⓑ | 92 | 50 | 0.42 |
| 3 | Cased Coil (Iron Sheet Casing) | Oil | Opened Magnetic Path | Specification Ⓒ | 72 | 42 | 0.20 |
| 4 | Cased Coil (Glass Casing) | \| | \| | \| | 96 | 44 | 0.20 |
| | | | | | dB μV/m | dB μA | A/μs |

It is apparent from the table 1 that (a) in the case of the molded type ignition coil, difference is found in the radiation of noise in dependence on the coil specifications (core structure and winding specifications), and (b) in the case of the iron sheet case type ignition coil, the iron case or housing is effective as a shield for the noise radiation.

Subsequently, the ignition coil identified by the specimen No. (1) in the table 1 was modified by removing deliberately the secondary winding to prepare a specimen No. (5) which was then measured with regard to noise by the method similar to that illustrated in FIG. 1, the results of the measurement being listed in the following table 2.

TABLE 2

| Specimen No. | Type | Filler Material | Core Structure | Specification of Winding | Field Strength (Radiation Noise) | Noise Current |
|---|---|---|---|---|---|---|
| 1 | Molded Coil | Epoxy Resin | Closed Magnetic Path | Specification (A) | 100 | 54 |
| 5 | \| | \| | \| | Primary Winding (A) Without Secondary Winding | 100 | 53 |
| | | | | | dB μV/m | dB μA |

As can be seen from the table 2, remarkable noise in the frequency band of several hundred kilohertzs or less (at 300 kHz in the measurement actually performed) is radiated only by turning on and off the primary winding regardless of presence or absence of the secondary winding, i.e. notwithstanding of the absence of electric discharge at the ignition plug 2 shown in FIG. 1.

FIG. 3 of the accompanying drawings shows a waveform of the primary current of the ignition coil measured synchronously with that of the noise current at 300 kHz recorded by the method illustrated in FIG. 2. From these waveforms, it could be confirmed that noise of greater magnitude is generated at the time of interrupting the primary current of the ignition coil than at the time when the coil is turned on.

Under the circumstances, the primary current falling rate dI/dt (slope of the trailing edge of the primary current making appearance upon turning-off of the ignition coil) was checked by enlarging the waveform of the primary current at the turn-off time point for each of the ignition coils of various winding specifications listed in the Table 1 through the method similar to that shown in FIG. 2. As the result of this, it has been found that noise in the frequency band of several hundred kilohertzs or lower bears a relationship to the slope of the trailing or falling edge (hereinafter referred to as falling rate) of the primary current of the ignition coil.

SUMMARY OF THE INVENTION

Accordingly, it is an object to provide concrete means for reducing noise by eliminating the factors which exert influence to the falling rate of the primary current of the ignition coil upon interruption thereof.

Parenthetically, in conjunction with the oil-filled iron-cased type ignition coil used widely heretofore, the fact that the radio noise of AM band of several hundred kilohertzs or lower presents substantially no problem may be explained by that the iron case functions as a shield for reducing the radiation noise, as can be seen in the table 1.

Accordingly, it is another object of the present invention to reduce effectively the generation of noise in the frequency band of several hundred kilohertzs or lower notwithstanding of the use of the molded type closed magnetic circuit ignition coil.

In view of the above and other objects which will be more apparent as description proceeds, there is provided according to an aspect of the present invention a contactless ignition apparatus for an internal combustion engine which comprises a resin-molded closed magnetic circuit type ignition coil including an iron core forming a closed magnetic circuit, a primary winding and a secondary winding wound on the iron core, respectively, and mold resin for insulating the primary and secondary windings, a semiconductor switching circuit for interrupting a current flowing through the primary winding, and an ignition plug to which a high voltage induced in the secondary winding upon interruption of the current flowing through the primary winding by the semiconductor switching circuit is applied, wherein the falling rate (slope of the falling or trailing edge) of the primary current appearing at the time when the primary current is interrupted by the semiconductor switching circuit is set at a value in a range of 0.2 to 0.4 (A/μs).

With the structure described above, the primary current of the resin molded closed magnetic circuit type ignition coil can fall upon interruption thereof at the rate of a value in a range of 0.2 to 0.4 (A/μs), whereby noise in the frequency band of several hundred kilohertzs or lower can be reduced significantly.

DESCRIPTION OF THE PREFERRED EMBODIMENTS

Now, the present invention will be described in detail in conjunction with exemplary or preferred embodiments thereof by reference to the drawings.

Figure 4:
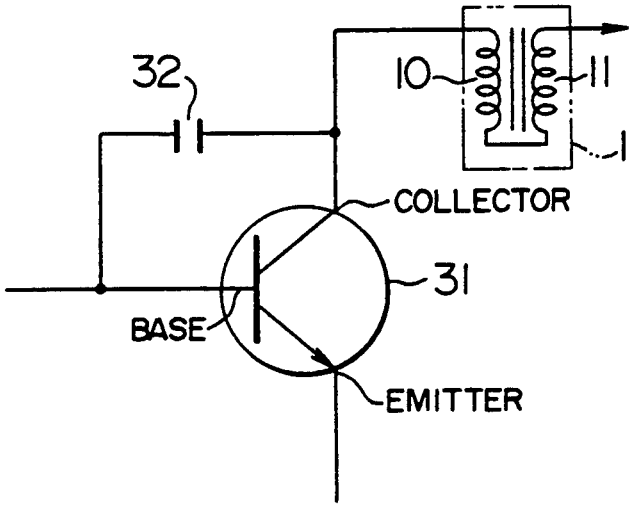
FIG. 4 is a circuit diagram showing a main portion of a contactless ignition apparatus according to an embodiment of the present invention.

FIG. 4 shows a part of an igniter 3 together with a resin-molded type closed magnetic circuit ignition coil 1 which has a primary winding 10 connected in series to a transistor 31 having a capacitor 32 connected between the collector and the base in such a manner as shown in the figure. The ignition coil 1 used in the illustrated embodiment is implemented in accordance with the specifications (A) listed in the tables 1 and 2 mentioned hereinbefore.

Figure 5:
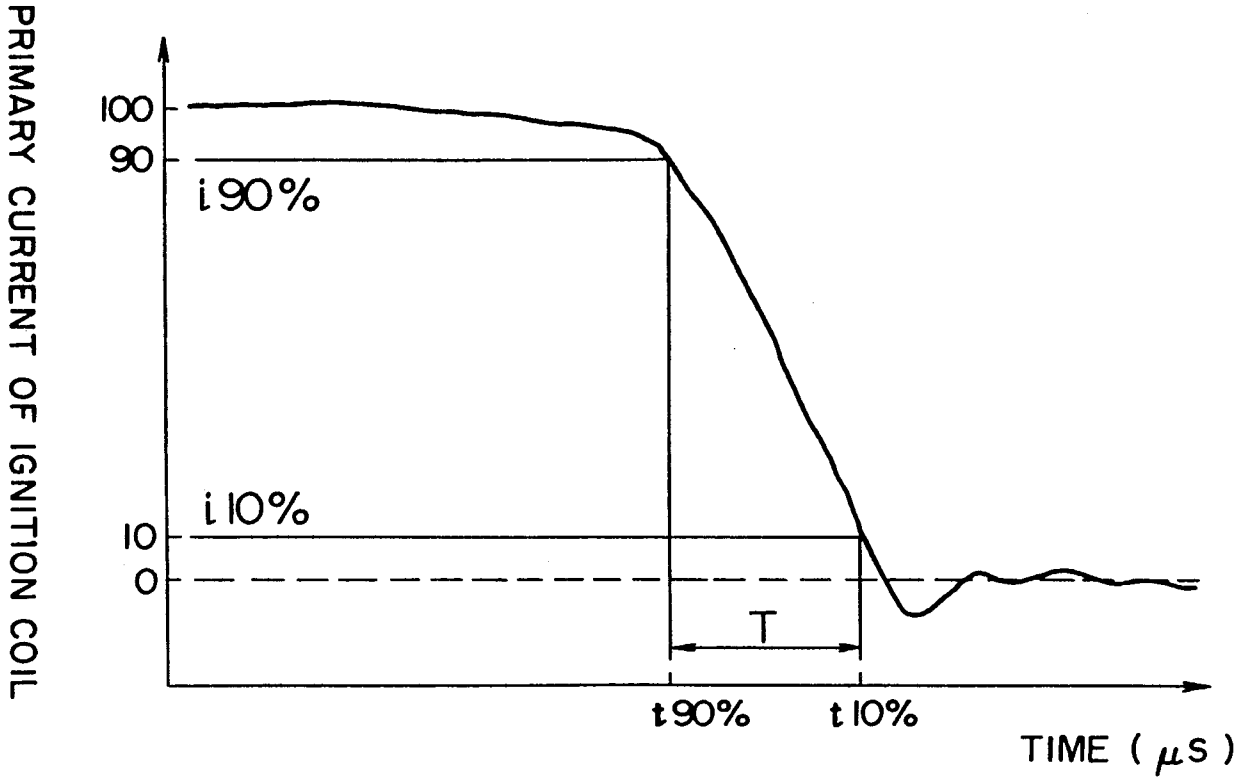
FIG. 5 is a waveform diagram for illustrating graphically a transition of a primary current upon interruption thereof as a function of time.

Referring to FIG. 5, there is graphically illustrated on a magnified scale the falling behavior of the primary current of the ignition coil 1 detected upon interruption thereof with the aid of a current probe 5 and an oscilloscope 6. As described hereinbefore, the inventor of the present application has discovered that the falling rate of the primary current upon interruption (off) thereof given by $$\frac{dI}{dt} = \frac{i\,(90\%) - i\,(10\%)}{T}\ [A/\mu s]$$

has influence to noise radiation from the ignition coil 1.

Figure 1:
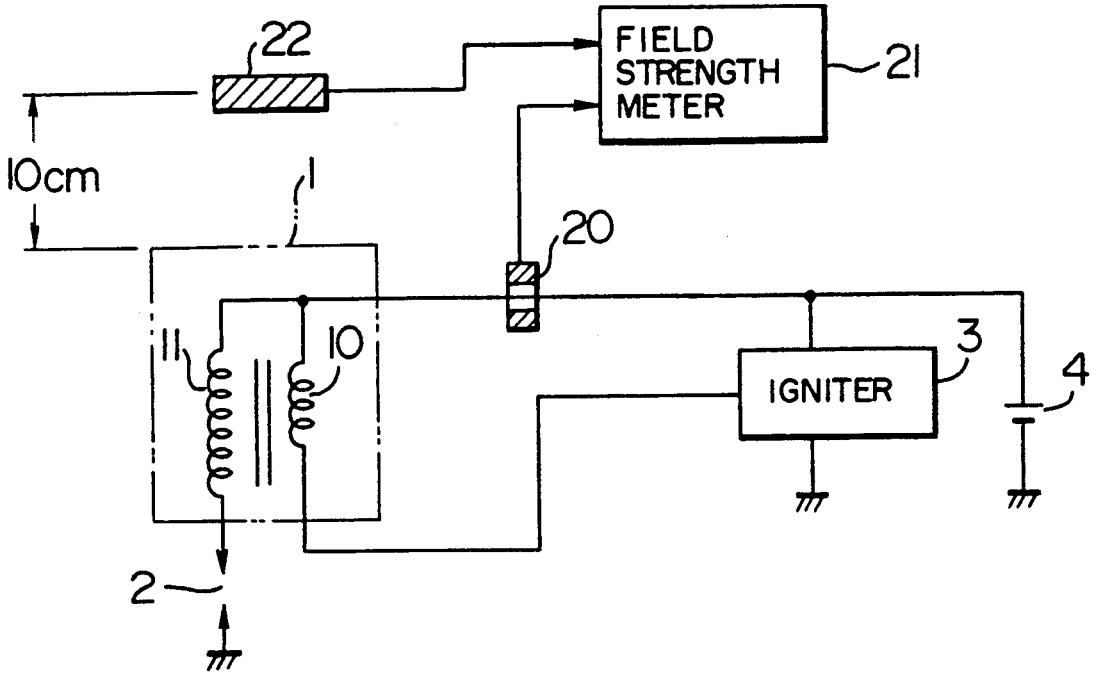
FIGS. 1 and 2 are electric circuit diagrams showing general arrangements of tester apparatuses for measuring radiation noise and current noise, respectively.
Figure 2:
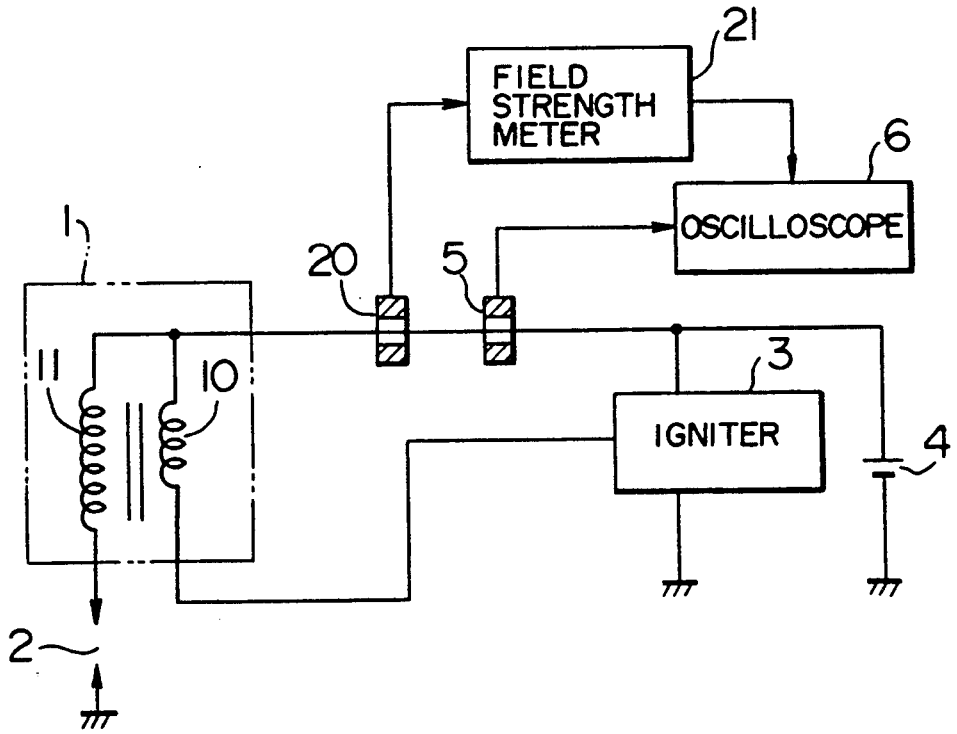
Figure 3A:
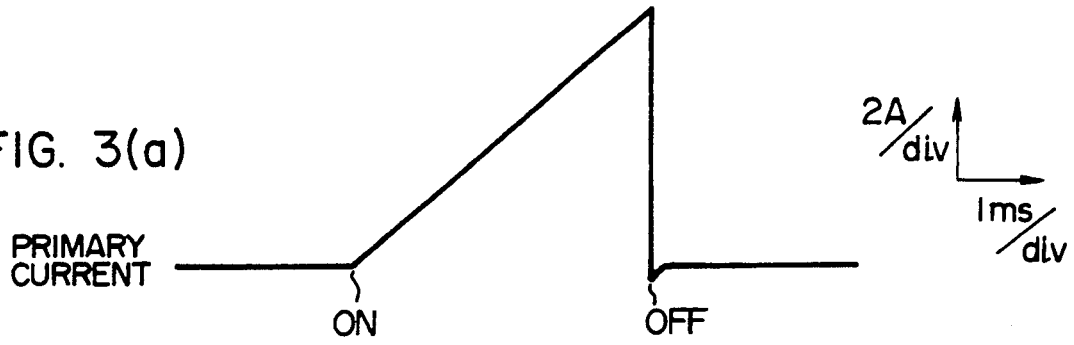
FIGS. 3(*a*) and 3(*b*) are a waveform diagram showing a waveform of a primary current of an ignition coil and that of a noise current, respectively.
Figure 3B:
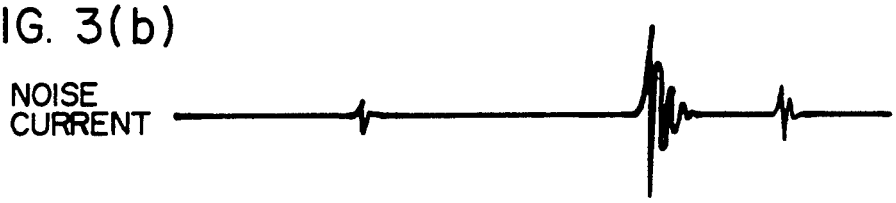
Figure 6:
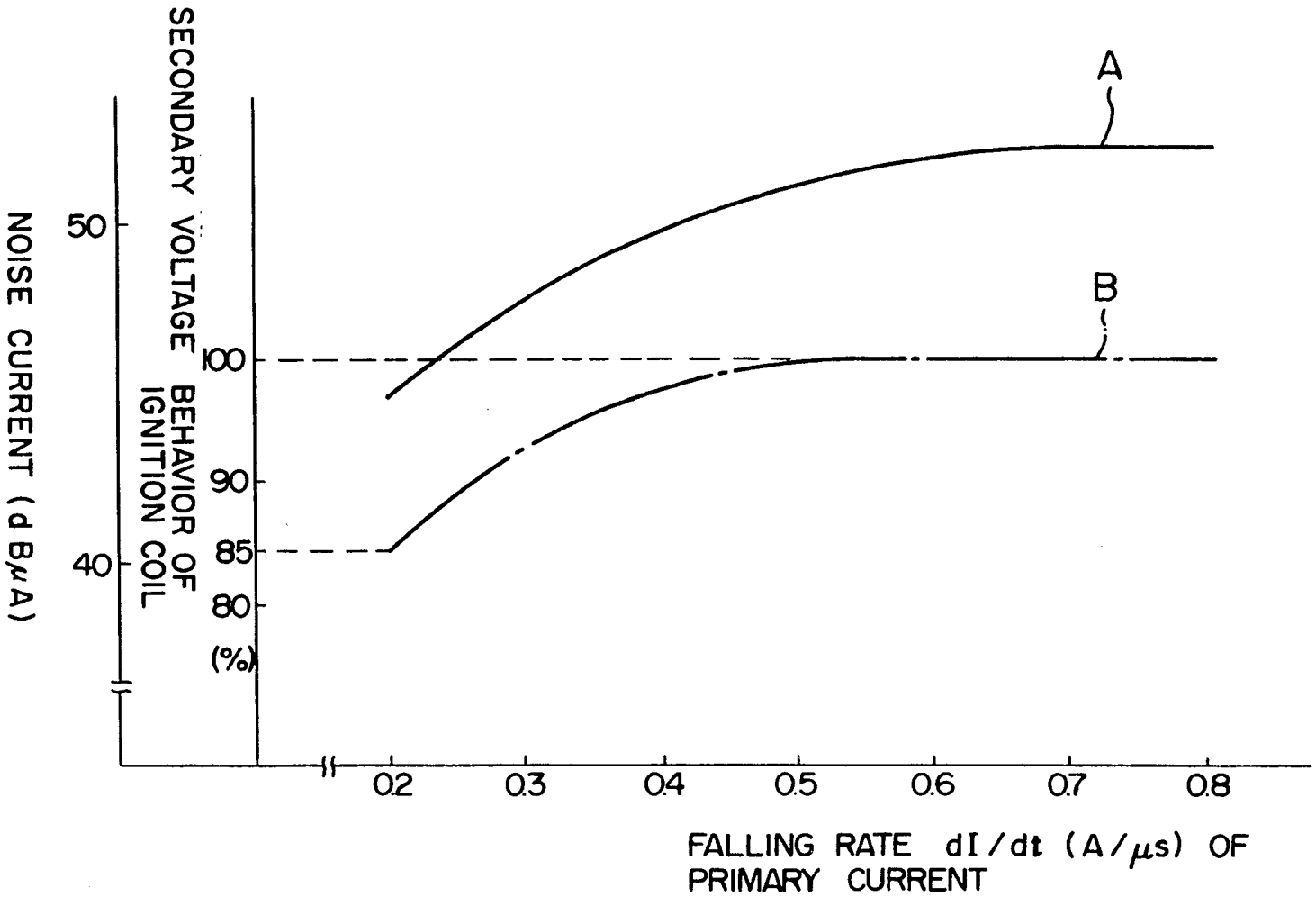
FIG. 6 is a view for illustrating graphically relations found between the falling rate of a primary current of the ignition coil upon interruption thereof and a radiation electric field and a secondary voltage behavior of the ignition coil, respectively.

More specifically, when noise current at 300 kHz measured by the current probe 20 and the field strength indicator 21 shown in FIG. 2 is taken along the ordinate with the falling rate dI/dt of the primary current taken along the abscissa, as is shown in the characteristic diagram of FIG. 6, it can be seen that the value or magnitude of the noise current (and thus noise) is decreased as the falling rate dI/dt of the primary current is decreased (see a solid curve A in FIG. 6).

Parenthetically, it is generally known that the field strength (noise radiation) radiated from an electromagnetic wave generating source is in proportion to the noise current in the electromagnetic wave generating source.

According to the teaching of the invention incarnated in the illustrated embodiment, the capacitor 32 is inserted between the collector and the base of the transistor, as shown in FIG. 4, for the purpose of decreasing the falling rate dI/dt of the primary current.

Figure 7:
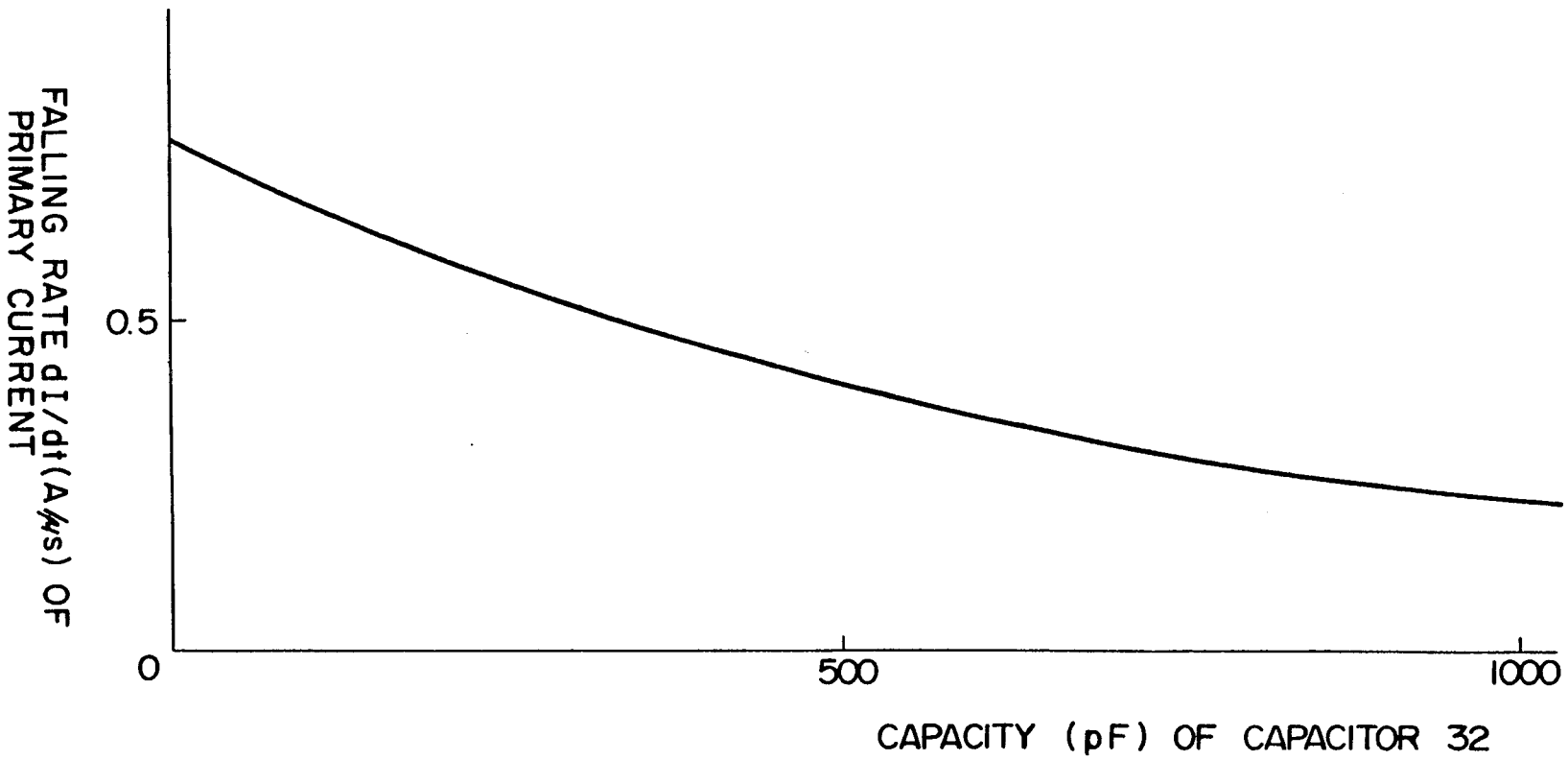
FIGS. 7 and 8 are views for illustrating graphically the relation found between the falling rate of the primary current and capacity of a capacitor employed according to an aspect of the invention.
Figure 8:
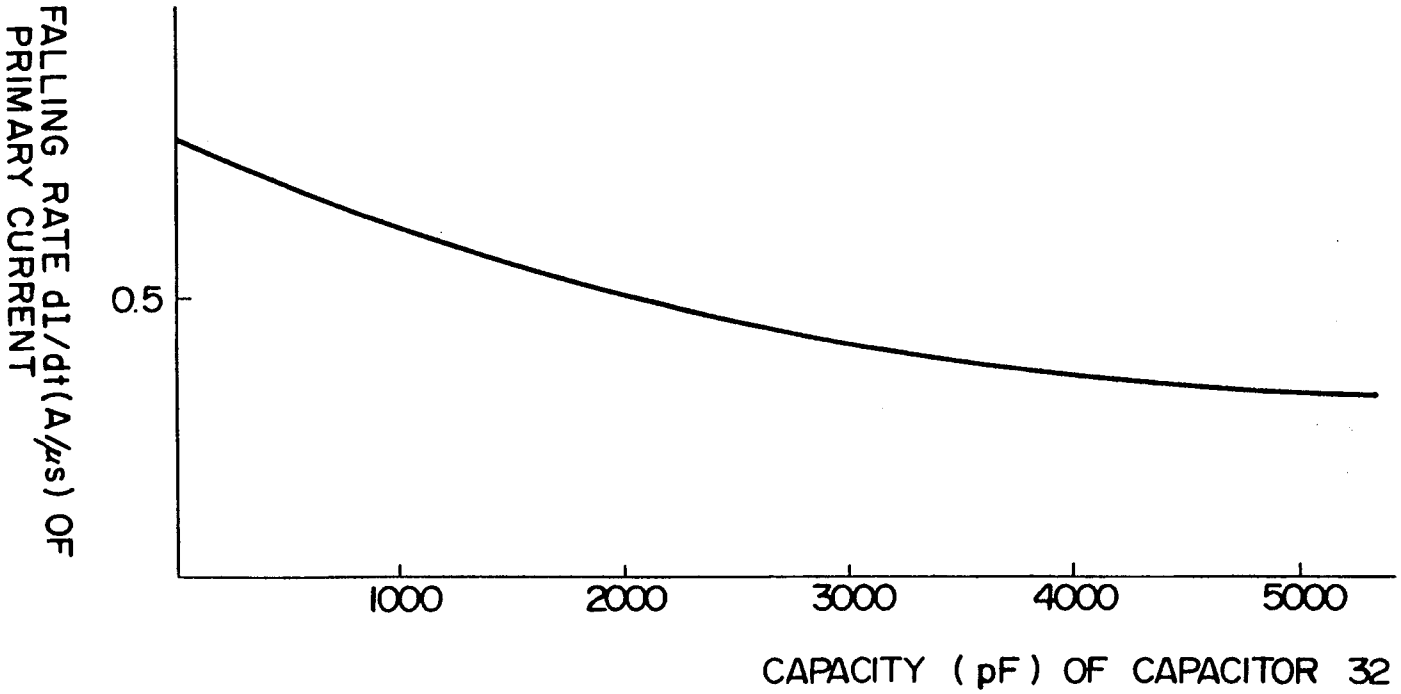

The values of the capacitor 32 are shown in FIG. 7 and 8 for the ignition apparatuses of internal combustion engines of 1800 cc and 1600 cc, respectively, used in motor vehicles or cars. As can be seen from these figures, as the capacity of the capacitor 32 is increased, the falling rate dI/dt of the primary current is decreased. It can further be seen that the relation between the capacity of the capacitor 31 and the falling rate dI/dt varies in dependence on the types and dimensions of the ignition apparatus. Under the circumstance, it is necessary to determine the optimal value of the capacitor 32 by taking into account the type of the transistor 31 and those of the components of the igniter 3, the circuit configuration thereof as well as combination with the ignition coil, and others.

On the other hand, it has been found that the secondary voltage generated in the secondary winding of the ignition coil is lowered when the falling rate dI/dt of the primary current is decreased, as can be seen from a curve B shown in FIG. 6. The lowering of the secondary voltage is accompanied with corresponding degradation in the performance of the ignition coil. In view of this, the lower limit of the falling rate dI/dt of the primary current is selected to be 0.2 (A/μs) which corresponds to 85% of the secondary voltage of the ignition coil to which the anti-noise measure taught by the invention is not applied.

In practice, the maximum voltage required for the ignition plug 2 is generally considered to be about 30 kV in consideration of wear of the ignition plug in the course of the use thereof in the motor vehicle. Accordingly, the secondary voltage of the ignition coil should preferably be set at about 35 kV with a margin. Consequently, the lower limit to which the secondary voltage of the ignition coil 1 is allowed to be lowered while reducing the noise as aimed is considered to be 85% of the ignition plug voltage as required with the above-mentioned margin being afforded to the ignition coil 1.

In this connection, it is conceivable to design previously the ignition coil 1 so that higher secondary voltage can be generated for the purpose of compensating for the lowering thereof due to the noise reduction measures. However, to this end, the number of turns for the secondary winding of the ignition coil 1 needs to be increased, which in turn means that the size and the weight of the ignition coil 1 are correspondingly increased, giving rise to problem in connection with the mounting of the coil 1, not to say of increasing in the manufacturing cost thereof.

The maximum value or upper limit of the falling rate dI/dt of the primary current of the ignition coil is experimentally determined to be 0.4 (A/μs) as the result of tests performed on the internal combustion engines of 1800 cc by evaluating acoustically the radio noise, the results of which are summarized in the table 3. It will be seen that the acoustically permissible level of noise (not lower than the evaluation score of "3") corresponds to the falling rate dI/dt equal to 0.4 (A/μs).

TABLE 3

| | dI/dt = (A/μs) | | |
|---|---|---|---|
| | 0.8 Evaluation Score 2 | 0.4 Evaluation Score 3 | 0.2 Evaluation Score 4 |
| Radio Noise | . Significant radio Noise | . Less Significant Radio Noise | . Insignificant Radio Noise |
| Result of Auditory Evaluation of Radio Noise | . Remarkable Disturbance with Discomfort | . Disturbance with Less Discomfort | . Disturbance Without Discomfort |

Figure 9:
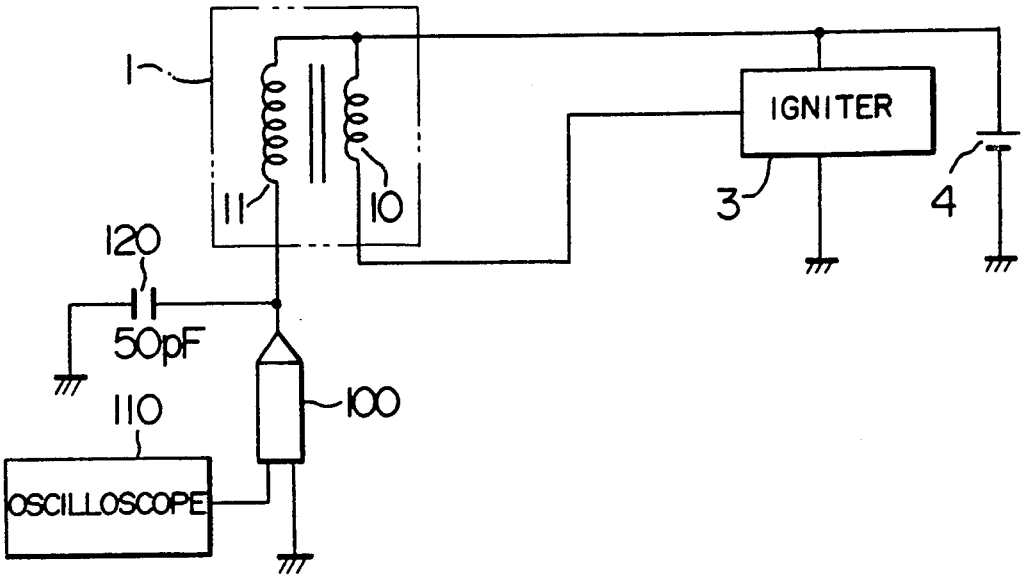
FIG. 9 is a diagram showing an electric circuit for measuring a voltage induced in the secondary winding of the ignition coil.

As the means for measuring the secondary voltage of the ignition coil 1, there are employed a high-voltage probe 100 connected to the secondary winding 11 of the ignition coil, a capacitor 120 of 50 pF and an oscilloscope 110 interconnected in such a manner as shown in FIG. 9.

In the case of the embodiment of the invention described above, the falling rate dI/dt of the primary current is decreased by inserting the capacitor 32 between the collector and the base of the transistor 31 constituting a part of the igniter 3. As a modification, the leakage inductance of the resin-molded closed magnetic circuit type ignition coil 1 may alternatively be increased to the same effect, as shown in FIGS. 10 and 11.

Figure 11:
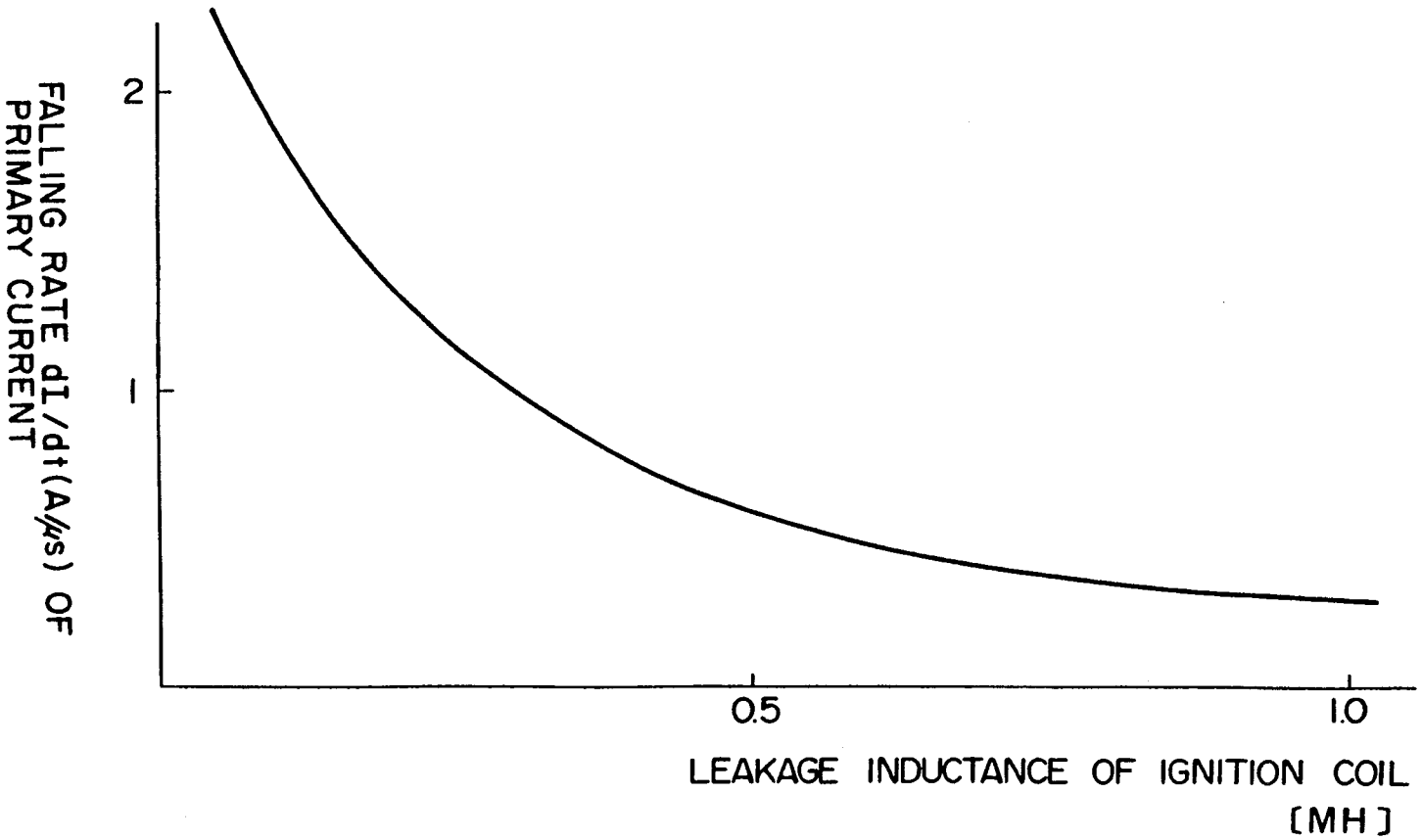
FIG. 11 is a view for illustrating graphically a relation found between the falling rate of the primary current and inductance of the ignition coil shown in FIG. 10.

More specifically, referring to FIG. 11, the ignition coil 1 includes a laminated core 12 of a rectangular frame-like shape in which an I-like laminated center core 13 is disposed with minute air gaps, whereby a closed magnetic circuit is formed. Each of the laminated cores 12 and 13 is constituted by a laminate of silicon steel plates or sheets each having a thickness in a range of 0.25 mm to 0.5 mm. Fitted snugly onto the laminated center core 13 is a bobbin 14 formed of a resin on which a primary winding 10 is wound. A second bobbin 15 of a greater diameter than the bobbin 14 is disposed fittingly thereon which a short distance from the primary winding 10 and has a secondary winding 11 wound thereon. The components mentioned above are accommodated or cased within a housing formed of a resin, wherein the spaces among the individual components are filled with epoxy resin 17 which is thermally cured and serves for insulation.

Figure 10:
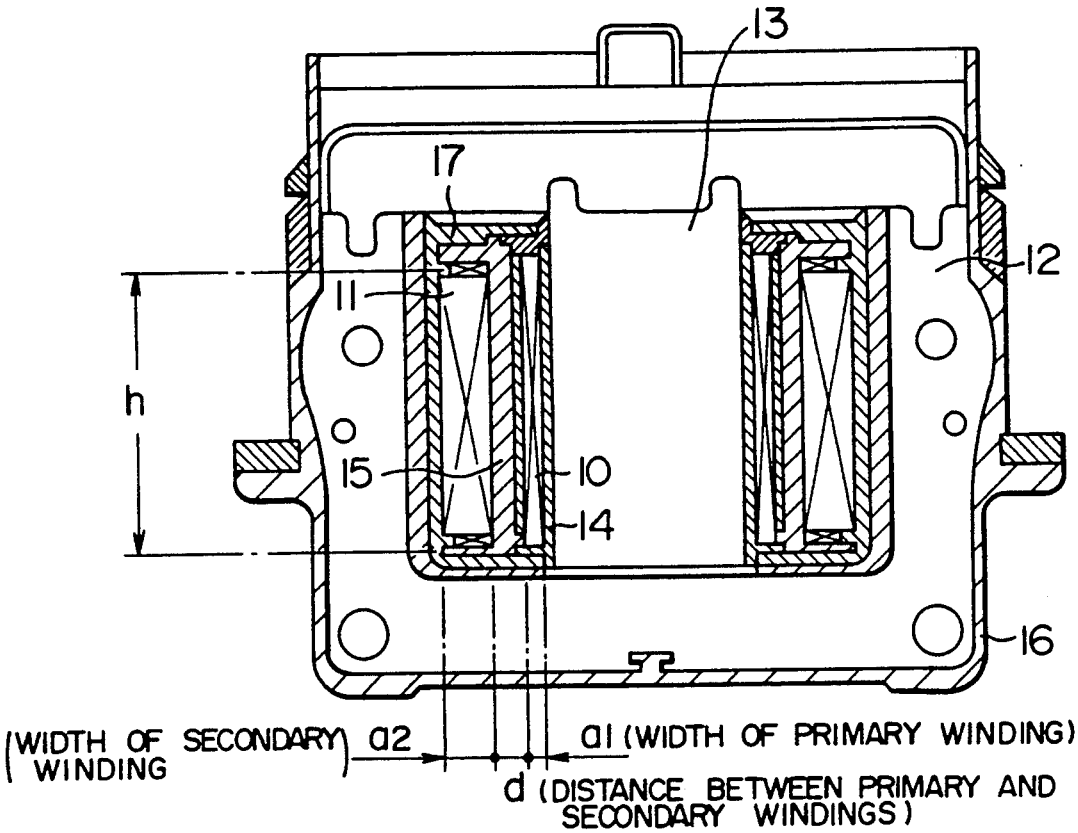
FIG. 10 is a sectional view showing an example of the ignition coil employed in the contactless ignition apparatus for an internal combustion engine according to an embodiment of the present invention.

In the ignition coil 1 shown in FIG. 10, the leakage inductance at the primary side can be expressed by $$Le = \mu N^2 l \left[ d + \frac{a_1 + a_2}{3} \right] / h$$

where N represents the number of turns of the primary winding, l represents a mean circumferential length of the primary and secondary windings 10 and 11 and μ represents the space permeability.

By taking into consideration the specifications of the individual components of the ignition coil 1, there can be obtained the leakage inductance Le of a desired value. FIG. 11 shows graphically a relation between the falling rate dI/dt of the primary current and the leakage inductances obtained by changing the specifications of the ignition coil shown in FIG. 10. As can be seen from FIG. 11, it is possible to decrease the falling rate dI/dt by increasing the leakage inductance Le.

In a concrete embodiment of the resin molded closed magnetic circuit type ignition coil 1 shown in FIG. 10, the specifications are so selected that the primary winding is constituted by winding a wire of 0.45 mm in diameter by 180 turns (T), the secondary winding is constituted by winding a wire of 0.05 mm in diameter by 12700 turns (T), the primary winding 10 has length h of 29 mm, the primary and secondary windings has widths a1 and a2 of 1.2 mm and 4 mm, respectively, the distance d between the primary winding 10 and the secondary winding 11 is 2.8 mm, and that the mean circumferential length l of the primary and secondary windings 10 and 11 is 105 mm.

On the basis of the dimensions mentioned above, the leakage inductance Le can be arithmetically determined to be 0.732 mH in accordance with the expression mentioned above. In the measurement performed actually on the ignition coil 1, the leakage inductance Le at the primary side of the ignition coil 1 was 0.780 mH which differs from the calculated value, the reason for which may be explained by the fact that the electromagnetic coupling coefficient susceptible to change under influence of the shapes of the primary winding 10, the secondary winding 11 and the cores 12 and 13, the positional relations among them and other factors exerts influence to the leakage inductance. The measurement of the leakage inductance mentioned above was carried out at a frequency of 1 kHz. It has been found that in the ignition coil according to the instant embodiment, the falling rate dI/dt of the primary current is 0.40 (A/μs).

The dimensions of the resin molded closed magnetic circuit type ignition coil of the specifications Ⓐ (refer to the table 1 and 2) implemented according to the embodiment shown in FIG. 4 were selected such that the primary winding 10 is of 0.7 mm (in wire diameter)×135 (number of turns T), the secondary winding 11 is of 0.05 mm (in wire diameter)×12700 (number of turns T), the coil length h of the primary winding 10 is 1.8 mm, the widths 1*a* and 2*a* of the primary and secondary windings 10 and 11 are 1.8 mm and 4 mm, respectively, the distance d between the primary winding 10 and the secondary winding 11 is 2.2 mm, and that the means circumferential length l of the primary and secondary winding 10 and 11 is 105 mm.

The leakage inductance Le of the ignition coil at the primary side was calculated on the basis of the value mentioned above in accordance with the expression mentioned hereinbefore and found to be equal to 0.375 mH. The actually measured leakage inductance Le of this ignition coil 1 was 0.4 mH.

Figure 13:
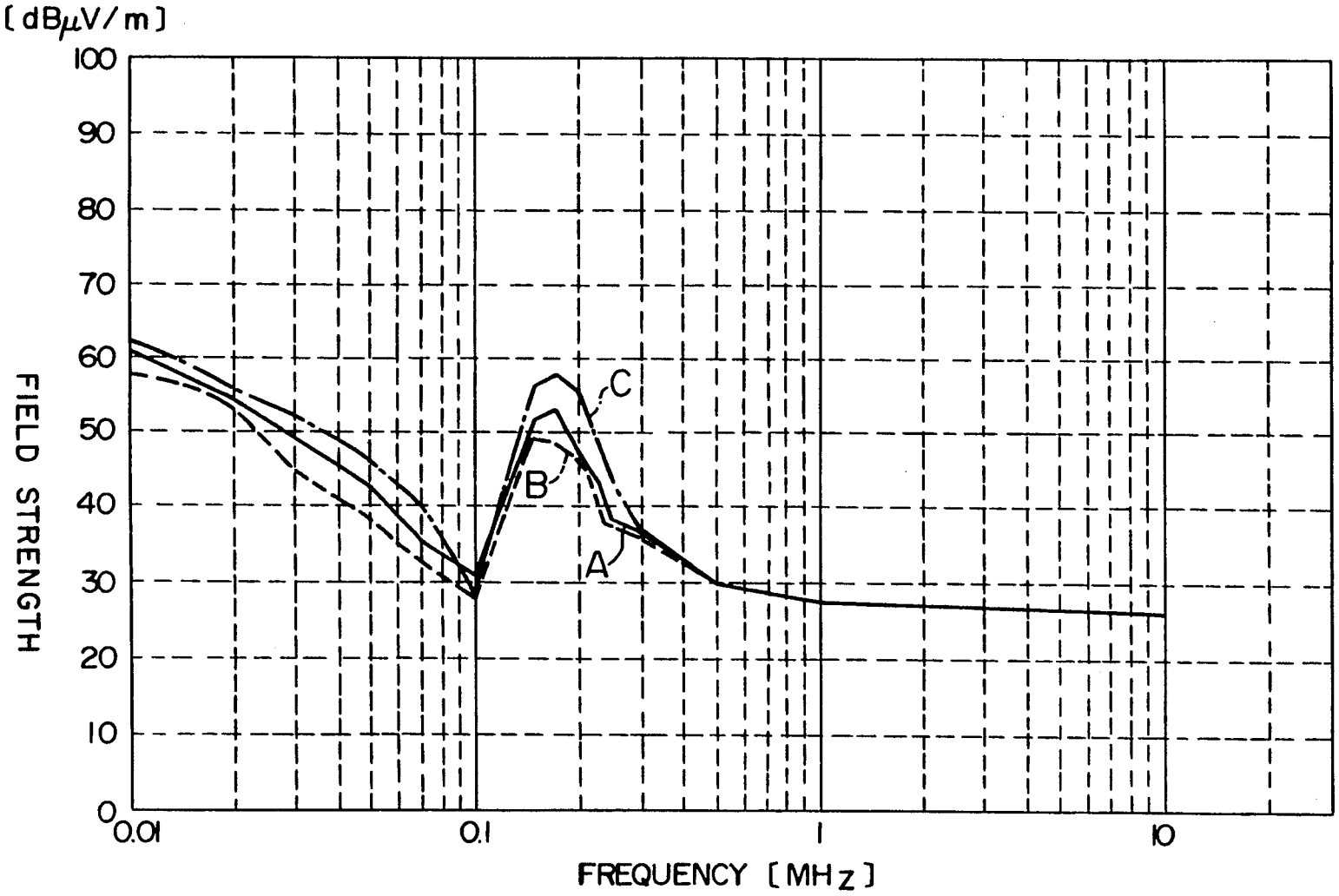
FIGS. 13 is a view for graphically illustrating relations of electric field strengths and frequencies.

Referring to FIG. 13, there are illustrated graphically relations between the electric field strength and the frequency of noise. More specifically, a solid line curve A represents the case in which the capacitor 32 of 560 pF is connected between the collector and the base of the transistor 31 of the igniter 3 for a four-cylinder engine of 1800 cc to thereby realize the falling rate dI/dt of 0.40 (A/μs), and a broken line curve B shows the case in which the capacitor 32 of 1000 μF is inserted to thereby realize the falling rate dI/dt of 0.20 (A/μs).

It can easily be understood from FIG. 13 that the ignition apparatus according to the teachings of the invention allows noise in the AM band to be significantly reduced when compared with the hitherto known apparatus (having no capacitor 32 and hence dI/dt of 0.76 [A/μs]) as indicated by a single-dot curve C (compare the curve C with A and B).

Figure 12:
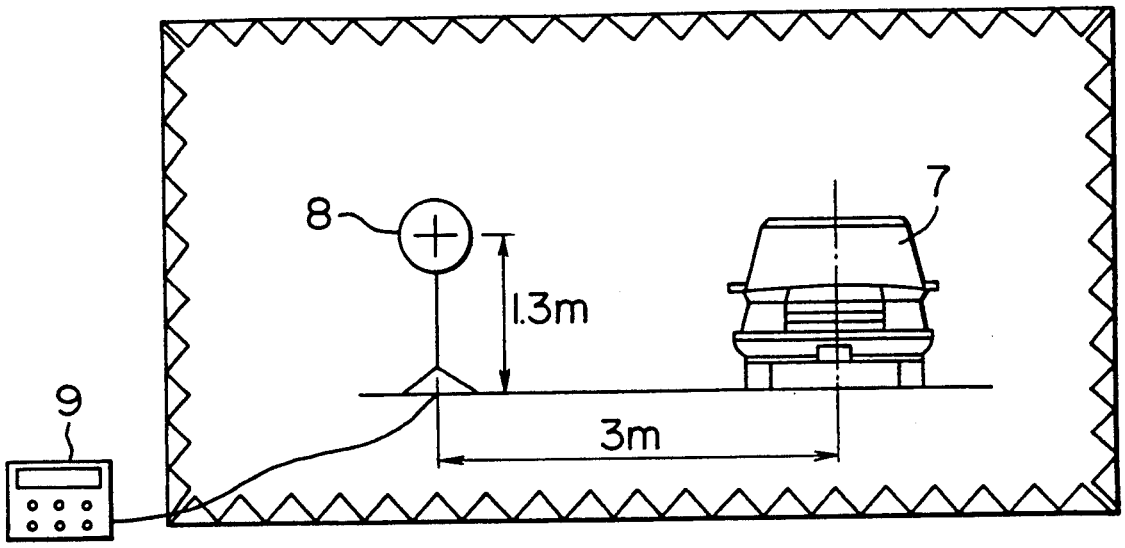
FIG. 12 is a view for illustrating schematically the conditions for the measurement of the electric field strengths illustrated in FIG. 13.

In the measurement of the radiated electric field shown in FIG. 13, the contactless ignition apparatus was mounted on a motor vehicle and the electric field strength was measured at a location distanced from the vehicle by 3 m with the aid of a loop antenna and a field strength meter 9, as shown in FIG. 12.

Figure 14:
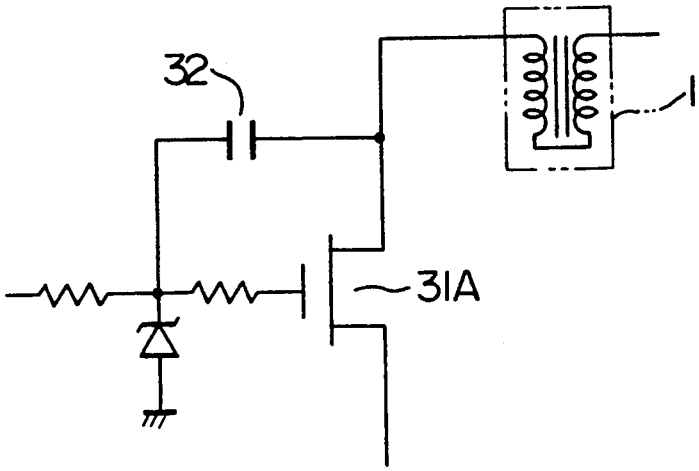
FIG. 14 is an electric circuit diagram showing a structure of a main portion of the contactless ignition apparatus according to still another embodiment of the present invention.

In the foregoing description of the illustrative embodiment shown in FIG. 4, it has been assumed that the bipolar transistor is employed which is widely used at present. It goes however without saying that MOS elements (such as MOS FET, IGBT) expected to be used increasingly can equally be employed to the substantially same effect as the bipolar transistor. In that case, the capacitor 32 of an appropriate capacity is inserted between a drain and a gate of a MOS element 31A, as shown in FIG. 14.

We claim:

1. A contactless ignition apparatus for an internal combustion engine, comprising:

a resin molded closed magnetic circuit type ignition coil including an iron core constituting a closed magnetic circuit, a primary winding and a secondary winding wound around said iron core, respectively, and mold resin for insulating said primary and secondary windings;

semiconductor switching means for interrupting a current flowing to said primary winding; and an ignition plug to which a high voltage generated in said secondary winding is applied upon interruption of the primary current flow to said primary winding by said semiconductor switch means;

wherein falling rate dI/dt of the primary current upon interruption thereof by said semiconductor switching means is set at a value in a range of 0.2 to 0.4 A/μs.

2. A contactless ignition apparatus for internal combustion engine according to claim 1, wherein a transistor is connected to said primary winding of said ignition coil as said semiconductor switching means for interrupting the primary current, and wherein a capacitor of a predetermined capacity is connected between a collector and a base of said transistor to thereby set said falling rate of said primary current at a value in the range of 0.2 to 0.4 A/μs.

3. A contactless ignition apparatus for internal combustion engine according to claim 1, wherein said ignition coil is so designed that leakage inductance thereof is higher than 0.7 mH, to thereby set the falling rate of said primary current at a value in the range of 0.2 to 0.4 A/μs.

4. A contactless ignition apparatus for internal combustion engine comprising a closed magnetic circuit type ignition coil for applying high electric energy to an ignition plug connected to a secondary winding of said ignition coil by interrupting a primary current flowing through a primary winding of said ignition coil, improvement comprising means for setting a falling rate of the primary current of said ignition coil upon interruption thereof at a value in a range of 0.2 to 0.4 A/μs.

* * * * *